US010549162B2

(12) United States Patent
Dyor et al.

(10) Patent No.: US 10,549,162 B2
(45) Date of Patent: Feb. 4, 2020

(54) GRAVITY-POWERED GOLF PUTTING RAMP

(71) Applicants: Matthew Graham Dyor, Bellevue, WA (US); Oliver Taggart Graham, Bellevue, WA (US)

(72) Inventors: Matthew Graham Dyor, Bellevue, WA (US); Oliver Taggart Graham, Bellevue, WA (US)

(73) Assignee: Random Stuff LLC, Bellevue, WA (US)

( * ) Notice: Subject to any disclaimer, the term of this patent is extended or adjusted under 35 U.S.C. 154(b) by 0 days.

(21) Appl. No.: 16/000,895

(22) Filed: Jun. 6, 2018

(65) Prior Publication Data

US 2018/0345107 A1 Dec. 6, 2018

Related U.S. Application Data

(60) Provisional application No. 62/515,628, filed on Jun. 6, 2017.

(51) Int. Cl.

| | |
|---|---|
| ***A63B 67/02*** | (2006.01) |
| ***A63B 69/36*** | (2006.01) |
| ***A63B 57/40*** | (2015.01) |
| ***A63B 63/00*** | (2006.01) |

(52) U.S. Cl.

CPC ..... *A63B 67/02* (2013.01); *A63B 57/405* (2015.10); *A63B 69/3676* (2013.01); *A63B 2063/001* (2013.01)

(58) Field of Classification Search

CPC ... A63B 67/02; A63B 57/405; A63B 69/3676; A63B 2063/001

See application file for complete search history.

(56) References Cited

U.S. PATENT DOCUMENTS

| | | | | |
|---|---|---|---|---|
| 5,129,653 | A * | 7/1992 | Morris | A63B 67/02 473/184 |
| 2003/0207716 | A1* | 11/2003 | Bradstock | A63B 69/3623 473/194 |
| 2012/0021845 | A1* | 1/2012 | Slavik | A63B 47/00 473/160 |
| 2017/0056747 | A1* | 3/2017 | Merwin | A63B 69/3676 |

* cited by examiner

*Primary Examiner* — Jeffrey S Vanderveen

(57) ABSTRACT

A gravity-powered golf putting ramp configured to receive a golf ball in motion in a first direction, guide the golf ball using an arced ramp in a second direction that increases gravitational potential energy, and guides the golf ball in a third direction that is substantially the opposite the first direction. The gravity-powered golf putting ramp includes: a planar base that supports the gravity-powered golf putting ramp when it is placed on a planar surface; a leading edge connected to the planar base, the leading edge having a small height relative to a width of the leading edge; a putting arc configured to receive a golf ball in motion, the putting arc connected to the leading edge and oriented in a direction substantially similar to the planar base. The putting arc is configured to: guide the golf ball having a first amount of kinetic energy and having a first path that is at least partially in an upward direction from the planar base until the golf ball reaches an apex, at which point it has substantially no kinetic energy and does have an amount of potential energy relative to the planar base; and guide the golf ball in a return path that is substantially directionally different than the first path and that is downward from the apex.

6 Claims, 10 Drawing Sheets

GRAVITY-POWERED GOLF PUTTING RAMP

CROSS REFERENCE TO RELATED APPLICATIONS

This invention claims benefit of provisional patent application 62/515,628 filed on Jun. 6, 2017 entitled Gravity-Powered Golf Putting Ramp.

BACKGROUND

Field of the Invention

The present invention is directed to a Gravity-Powered Golf Putting Ramp.

Description of the Related Art

There are two primary ways to practice putting a golf ball: a pick up putting system, and a return putting system. A pick up putting system does not return a golf ball to a user. The user hits a golf ball with a putter and the golf ball travels along a first path. When the user has putted one or more balls, the user travels to the location where the first path ends and picks up or otherwise gathers the golf ball(s). Because the user needs to move from the original putting position to retrieve the golf ball(s), these systems are less effective.

A return putting system allows a user to put a golf ball with a putter and wait as the golf ball travels along a first path and is returned to the user substantially at the location from which the user putted the golf ball. A common device for putting is to use a golf hole with an electrically powered return apparatus, such as a hammer that pushes the golf ball towards the user so that the user can retrieve the golf ball without moving from the original putting location. Because these devices require power, they are less ideal in certain environments.

SUMMARY

The gravity-powered golf putting ramp enables provides a mechanism of returning a golf ball to a user without the use of electricity so that they can improve their putting skills in any environment.

BRIEF DESCRIPTION OF THE DRAWINGS

FIGS. 1(*a*) and 1(*b*) show the top view of the radial implementation of the gravity-powered golf putting ramp.

FIG. 1(*c*) shows a plan view of the radial implementation with a return ramp.

FIG. 1(*d*) shows a bottom view of the radial implementation with a return ramp.

FIG. 1(*e*) shows a bottom-oriented plan view of the radial implementation.

FIG. 1(*f*) shows a rear view of the radial implementation with a storage ramp.

DETAILED DESCRIPTION

Figure 1:
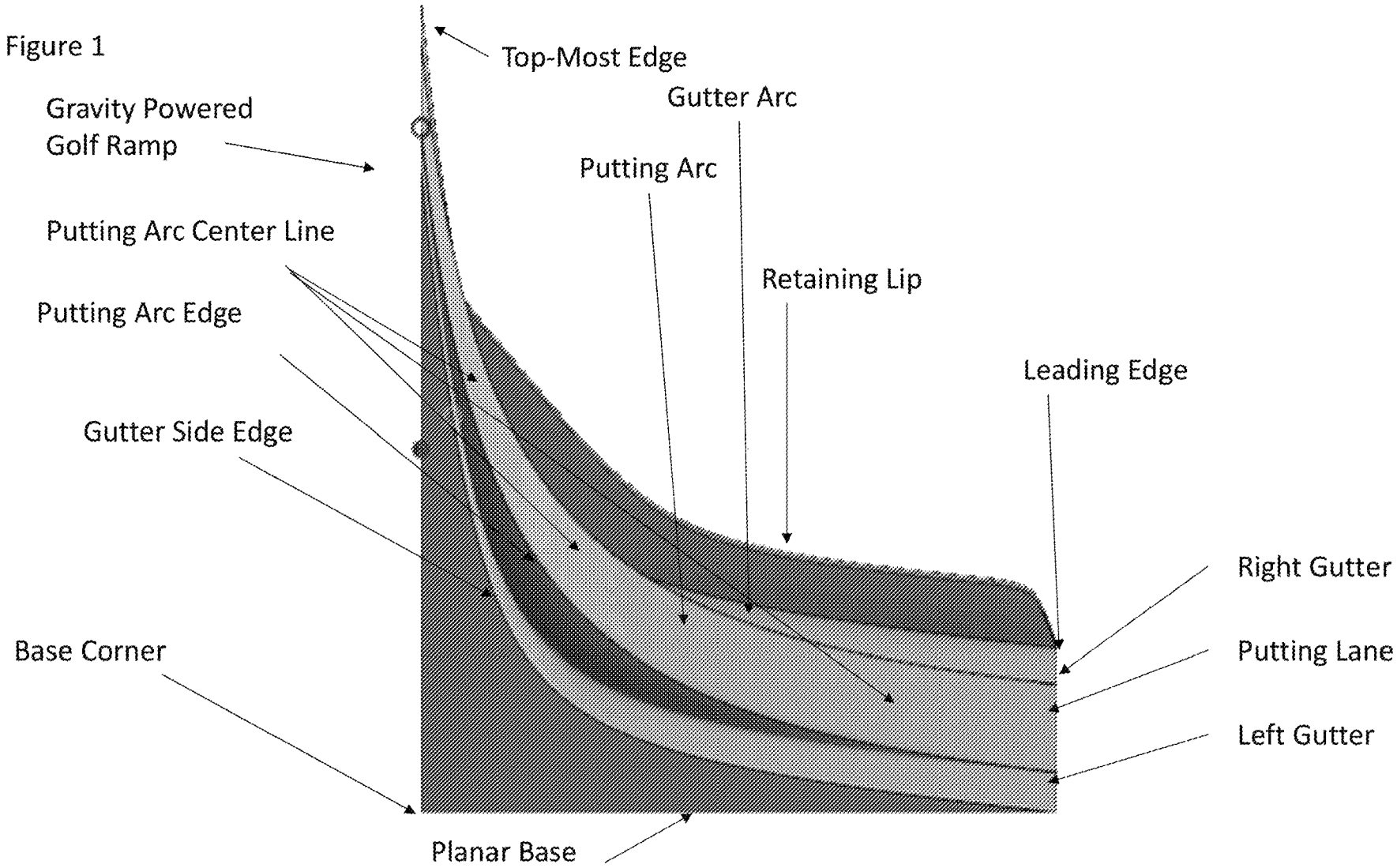
FIG. 1 is a slightly elevated side view of the gravity-powered golf putting ramp.
Figure 1B:
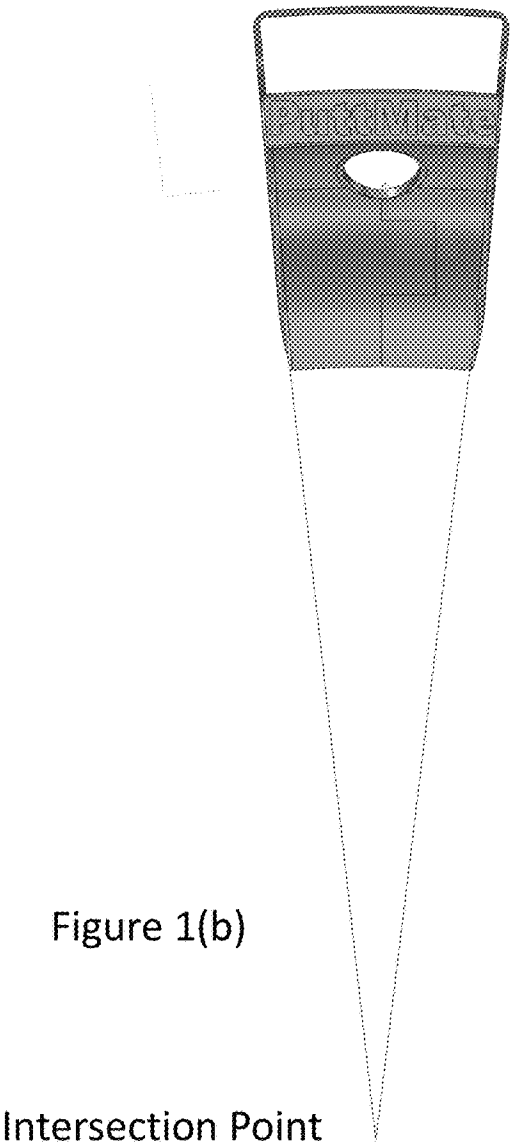
Figure 1A:
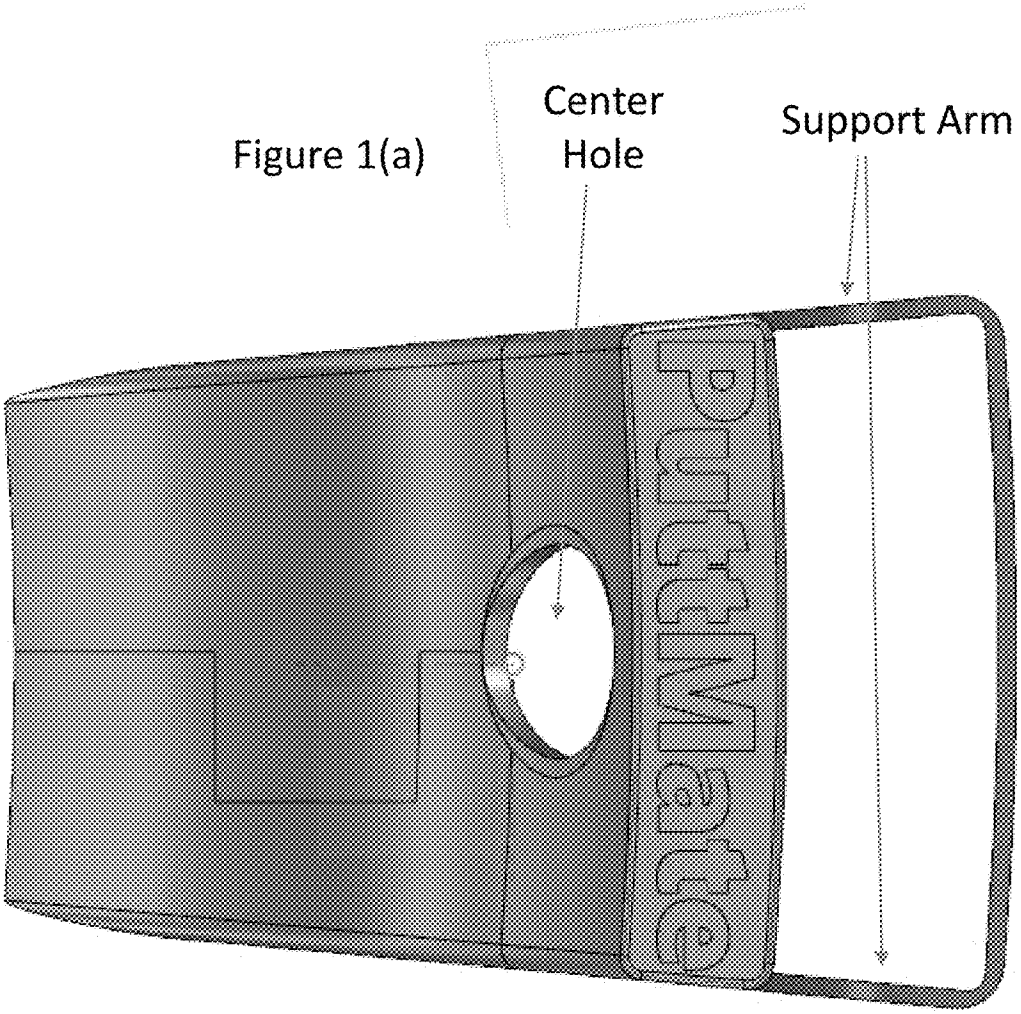
Figure 1C:
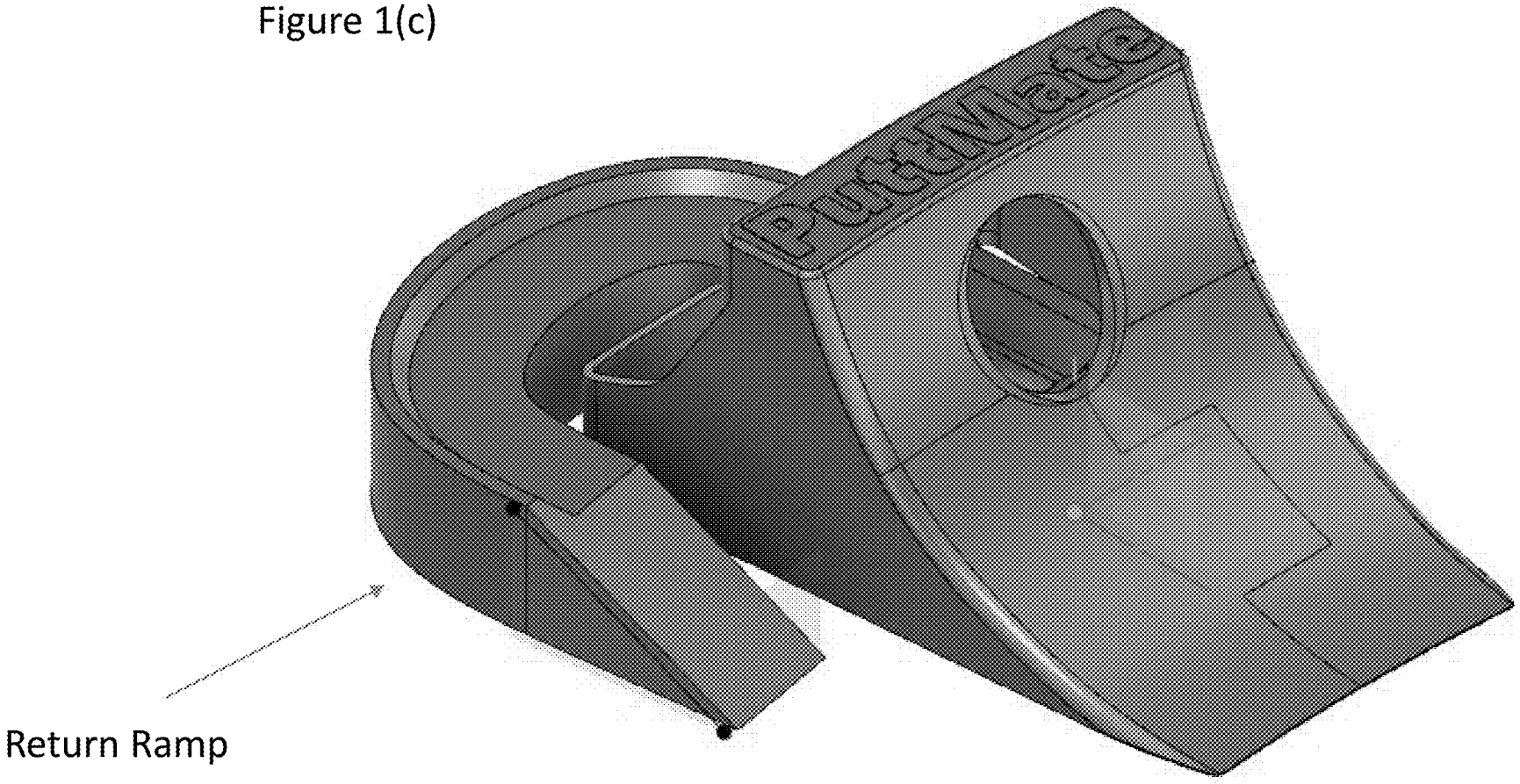
Figure 1D:
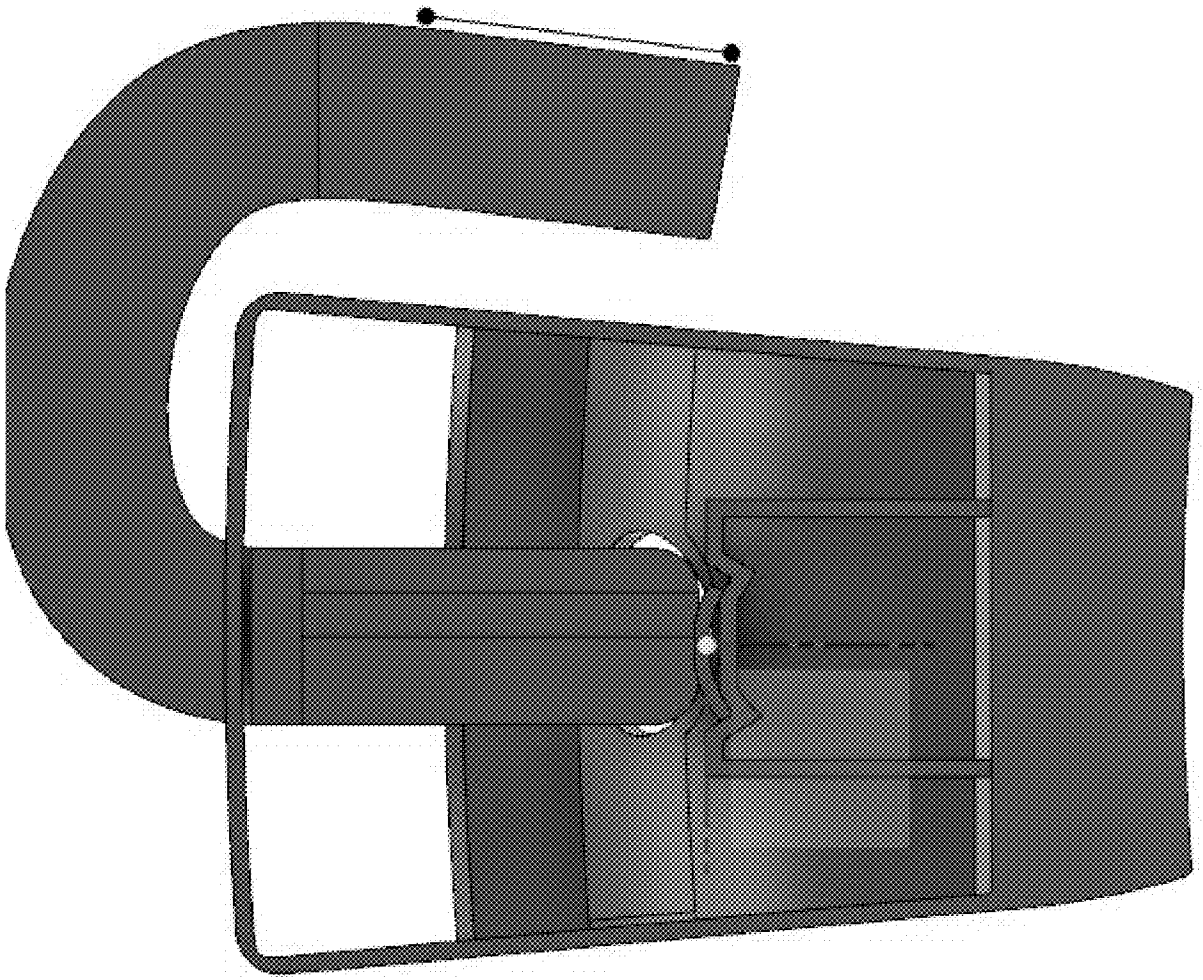
Figure 1E:
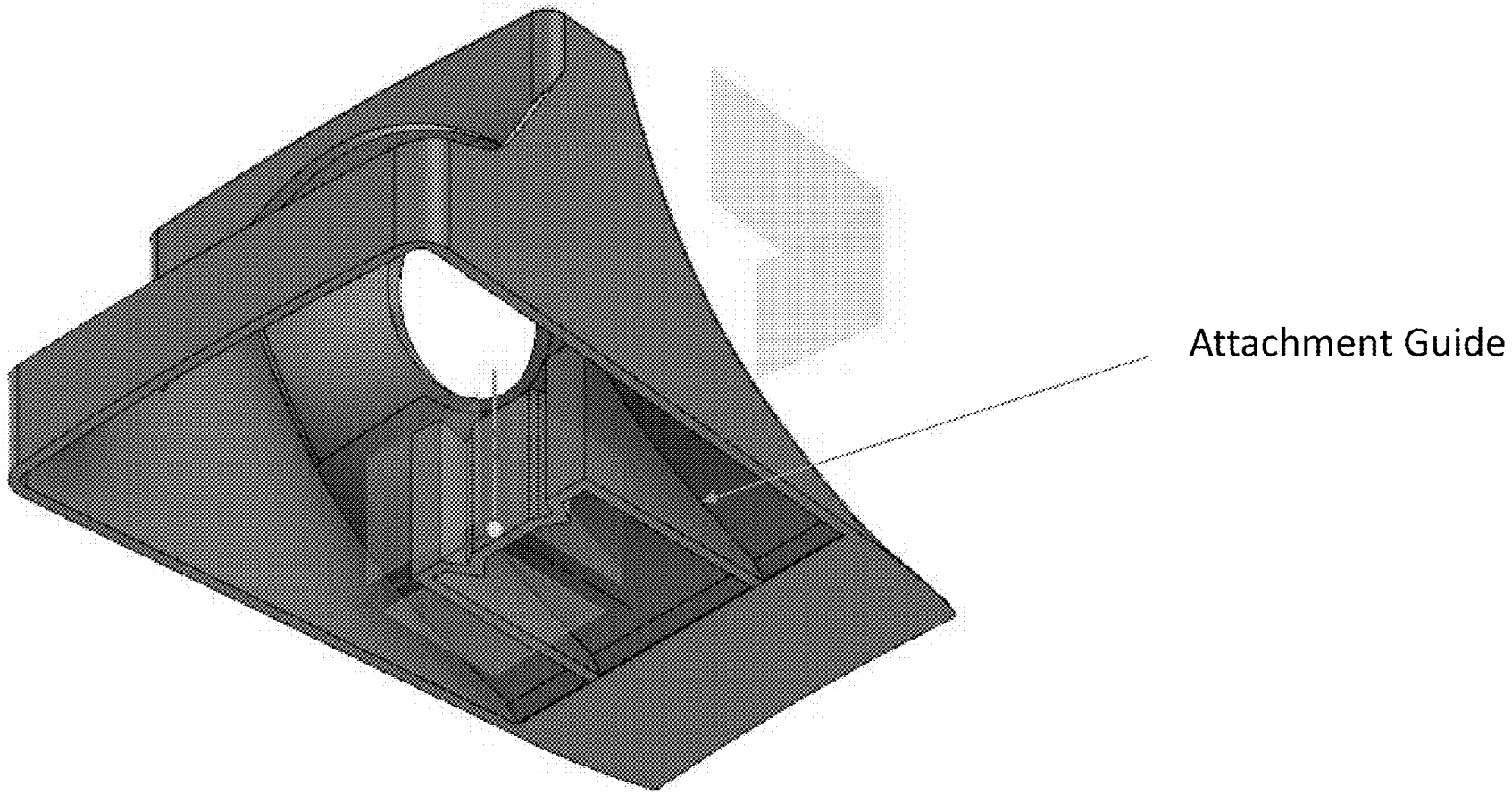
Figure 1F:
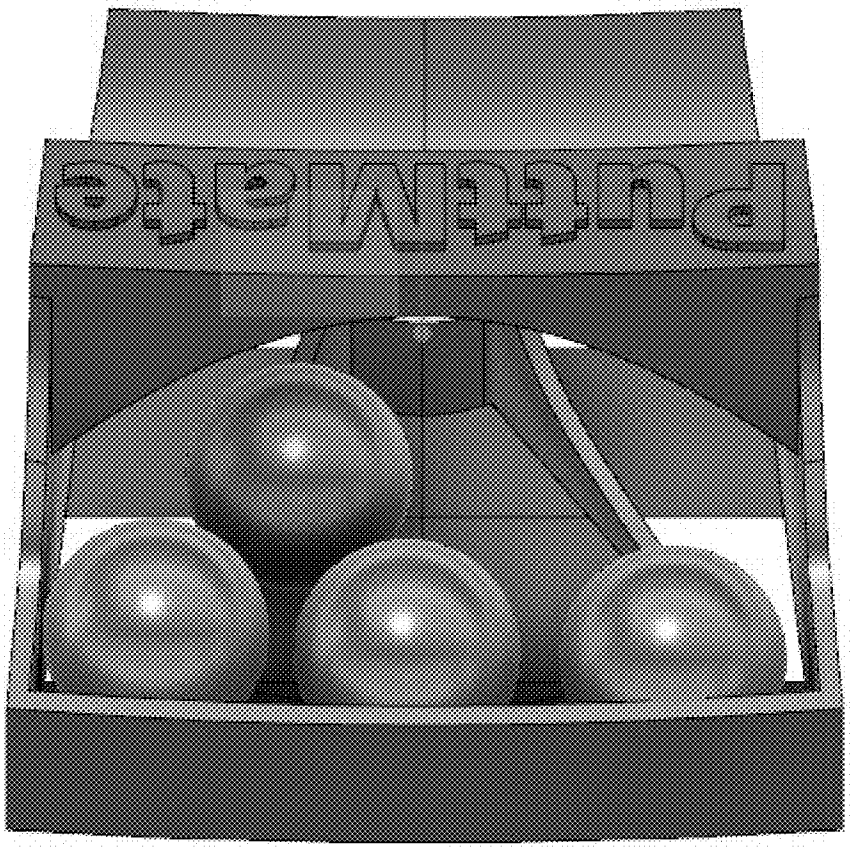
Figure 2:
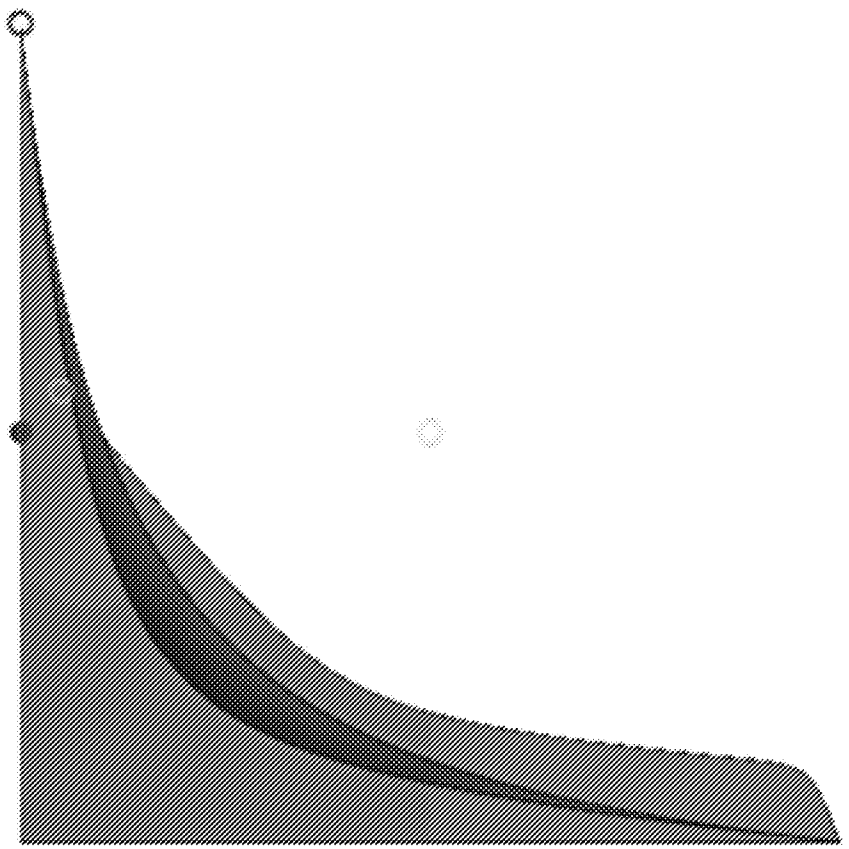
FIG. 2 is a side view of the gravity-powered golf putting ramp.
Figure 3:
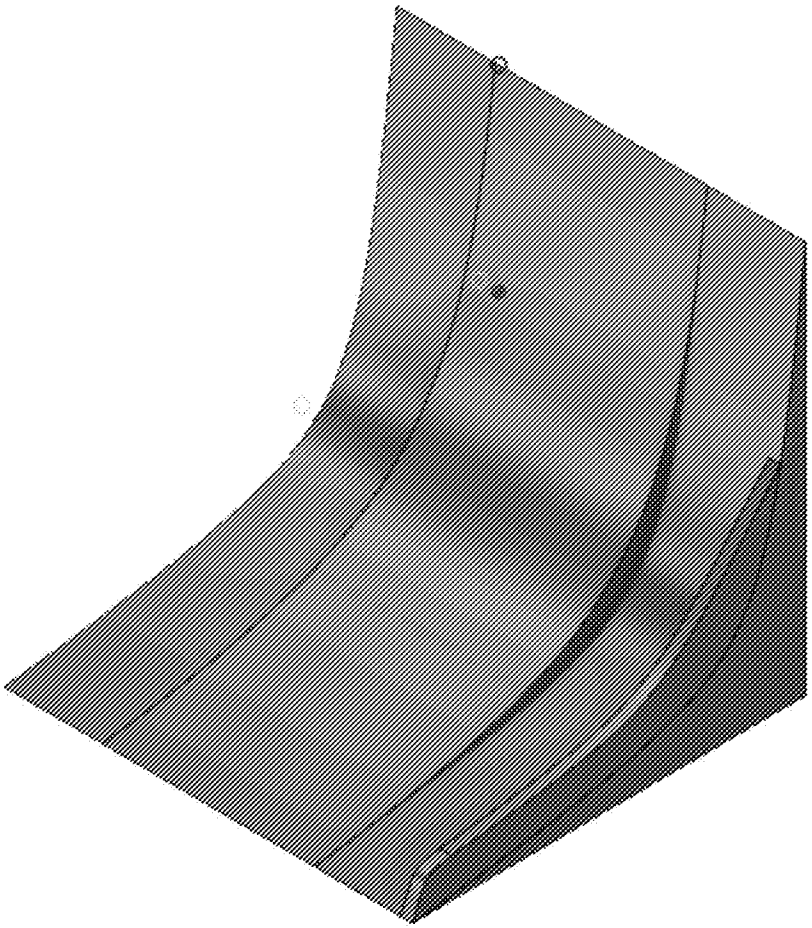
FIG. 3 is a plan view of the gravity-powered golf putting ramp.

FIG. 1 is a slightly elevated side view of the gravity-powered golf putting ramp. A gravity-powered golf putting ramp is configured to receive a golf ball in motion in a first direction, guide the golf ball using an arced ramp in a second direction that increases gravitational potential energy, and guides the golf ball in a third direction that is substantially the opposite the first direction. The gravity-powered golf putting ramp includes a planar base that supports the gravity-powered golf putting ramp when it is placed on a planar surface; a leading edge connected to the planar base, the leading edge having a small height relative to a width of the leading edge; and a putting arc configured to receive a golf ball in motion.

The putting arc is connected to the leading edge and oriented in a direction substantially similar to the planar base. The putting arc is configured to: guide the golf ball having a first amount of kinetic energy and having a first path that is at least partially in an upward direction from the planar base until the golf ball reaches an apex, at which point it has substantially no kinetic energy and does have an amount of potential energy relative to the planar base; and guide the golf ball in a return path that is substantially directionally different than the first path and that is downward from the apex.

In one embodiment, the gravity-powered golf putting may include a retaining lip on the edge of the gravity-powered golf putting ramp configured to prevent a golf ball in motion from falling off a side edge of the gravity-powered golf putting ramp.

The putting arc may be configured flat with respect to the putting arc center line. Alternatively, the putting arc may be configured with a center line slope, such that a ball traveling on the first path on the putting arc is guided away from a putting arc edge and toward the putting arc center line. The center line slope may be a linear or non-linear slope, so that the putting arc edge at a given distance from the leading edge is higher than the putting arc center line at the given distance from the leading edge.

The gravity-powered golf putting ramp may further include a grove down a putting arc center line configured to receive the golf ball down a predefined first and return path. For example, the putting arc center line may have a groove configured to bias a golf ball down a particular return path, such that a golf ball travelling across the putting arc center line (e.g., a golf ball that originally started at the putting arc edge and guided towards the putting arc center line by a center line slope) would be biased in a direction approximate or equal to the putting arc center line. In this way, a golf ball that is struck off a center line may still be returned along a path that intersects with a user.

The gravity-powered golf putting ramp may be configured with at least one gutter attached to an edge of the putting arc, the gutter having a gutter arc that defines an arc having a different slope than the putting arc. For example, the ramp may have two gutters, a right and left gutter, and these may receive (and return) a golf ball that is hit outside the putting lane. In this way, even golf balls that are not hit with sufficient accuracy can be returned to the user, allowing the user to more quickly make a subsequent put.

The gravity-powered golf putting ramp may be configured with a putting arc (also referred to as a putting lane) that is approximately the width of a golf hole, or 4.25 inches.

Because a golf ball that travels across the outer edge of a golf hole is unlikely to make it into the golf hole, the putting arc may be less than the width of a golf hole to approximate the effective width of a golf hole. Additionally, each of the gutters may be approximately the width of a golf ball, so that a golf ball could travel up the gutter to an apex, and then return down the gutter along a return path that is substantially the opposite of the initial putting path (e.g., back to the user). In one embodiment, the gutters may include a retaining lip on an outer edge of the ramp configured to guide a ball on a return path back to a user. Although the retaining lip may be a perpendicular wall, other configurations may be used, such as an arc travelling from the edge of the gutter to the center of the gutter, an arc travelling from the edge of the gutter to the edge of the ramp, or other configuration.

Figure 4:
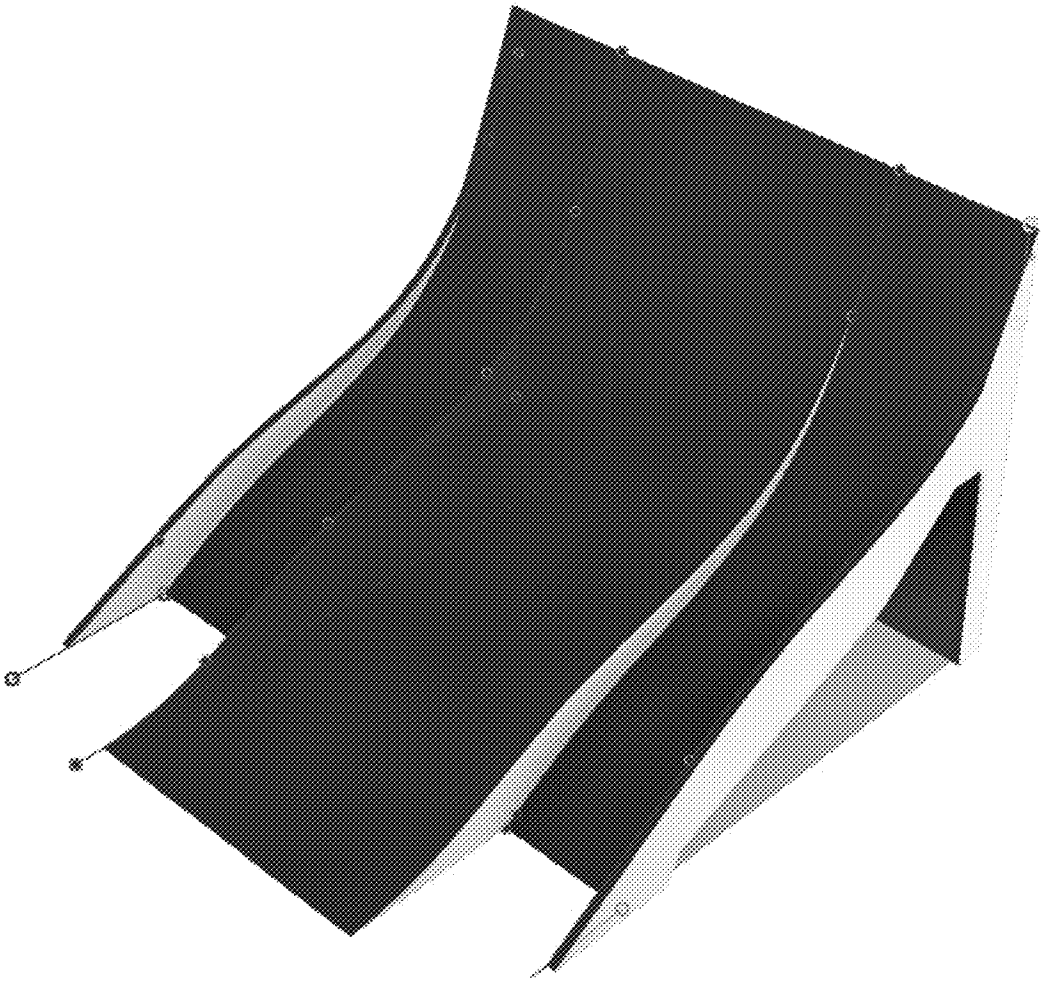
FIG. 4 is a plan view of a second embodiment of the gravity-powered golf putting ramp.

In one embodiment, the putting arc may be non-contiguous, meaning it has an irregular pattern such as a non-conic putting arc center line, as is shown in FIG. 4. In this way, a ball that has been putted with the appropriate velocity may travel over a first curve, but not over a second element (e.g., curve, lip, line, marker, etc., not shown). If a gutter lip (not shown) is used, the ball may travel on a return path that is not on the putting lane, to help a user identify that a putt was hit too hard. In one embodiment, the gutter lip may cause a ball hit too hard to return along a path that is on a gutter.

In one embodiment, the ramp may be configured with a thin, elevated, and contoured putting arc center line. For example, the putting arc center line may include a left and right protrusion have a width and height capable of guiding a golf ball in motion down a determined path. These protrusions may be smooth with respect to the leading edge, such that a golf ball that is struck into the leading edge will not slam or bounce, but instead will be guided to a left or right side of the protrusion. By keeping the left and right protrusions small, the diversion from a golf balls original path can be minimized.

As shown in FIG. 4, the gravity-powered golf putting ramp may be hollow to decrease the weight and/or cost of manufacture of the ramp. The ramp may have a virtual planar base that is defined by a combination of a base corner, a gutter side edge, and/or a putting arc edge. Additionally or alternatively, the ramp may have a virtual rear wall, a virtual left wall, and/or a virtual right wall. Some of the putting arc, gutter, and/or retaining lip may be virtual as well.

In one embodiment, the ramp may be configured without gutters, and configured to fit into the corner of a room, relying on the walls of the corner to prevent a travelling golf ball from falling off the edge of the ramp.

In one embodiment, the gravity-powered golf putting ramp may have a configurable shape. For example, the width of the putting ramp may be increased or decreased to increase or decrease the probability of putting a golf ball along the putting arc. This may be done by, for example, having an elastic material (e.g., rubbers, elastomers, etc.) for at least a portion of the putting arc, and then adjusting a screw (not shown) within or underneath the putting arc that presses out the gutter edge, thereby increasing the width of the putting arc. The shape of the ramp may be configured in other ways, such as the width of the gutters, the curvature of the putting arc and/or the gutter(s), and other elements of the ramp.

In one embodiment, the gutter(s) may have a gutter center line that is not parallel to the putting arc center line. In one embodiment, the gutter center line may be offset such that if the gutter center line and the putting center line were extended beyond the gravity-powered golf putting ramp, the lines would intersect at a point in front of the leading edge. For example, the center lines may be configured to intersect at a position where a user may strike a ball, such as 5 feet in front of the leading edge. In one embodiment, the offset of the gutter center line may be configurable.

The left and right gutter may be higher or lower than the putting lane, as shown in FIG. 1. Alternatively, the left and right gutter may be flush with the putting lane, as shown in FIG. 1(*a*) and FIG. 1(*b*). The configuration shown in FIG. 1(*b*) may be described as a radial ramp, where a line can be drawn from any point on the leading edge to a point on the top-most edge, and this line, if extended, would intersect with the intersection point. This radial embodiment allows a ball to hit the leading at any point (e.g., putting lane, or right or left gutter), travel up the putting/gutter arc to a point below the top-most edge, and return substantially to the intersection point so that the ball may be struck again. It is understood that the center hole depicted in FIG. 1(*a*) would prevent the ball from returning to the user. The ball may be stored inside the gravity-powered golf putting ramp as shown in FIG. 1(*f*), or it may be returned via a return ramp as described below with respect to FIG. 1(*c*).

FIG. 1(*a*) shows the top view of the radial implementation. In this top-view rendering, an intersection point exists at some point off the gravity-powered golf putting ramp, and a line can be drawn from any point on the top-most leading edge to a point on the leading edge, and that line will intersect with the intersection point. The shape of the ramp along these lines (e.g., from the left edge to the center to the right edge) is substantially identical, except if a center hole is cut out. This radial shape means that a ball that is released from the left or right edge of the gravity powered golf ramp would travel along the radial line across the leading edge and intersect with the intersection point. Similarly, if there was no center hole, a ball released from the center of the top most edge would also travel along a radial line across the leading edge and to the intersection point. In a preferred embodiment, the left, right, and center of the top-most edge are at substantially the same height, and the top most edge is wider than the leading edge. Described in another way, the leading edge has an arc defined by a first circle with a center point at the intersection point, the top-most edge has an arc defined by a second circle with the same center point, every point on the top-most edge is at substantially the same height from the planar base, and the ratio of the arc of the leading edge to the diameter of the first circle is substantially the same as the ratio of the arc of the top-most edge to the diameter of the second circle. This configuration may be described as a large sector (e.g., portion of a circle) ramp having a small sector cut out from the leading edge of the ramp to the intersection point, and having a substantially uniform height from the planar base across the entire face of the ramp at any given distance from the intersection point. This configuration enables a golf ball to be received at either the left or right edge of the ramp, travel up some or all of the way to the left or right edge of the top-most edge, and return to the intersection point without the use of retaining lips and without falling off the edge of the ramp. Falling off the edge of the ramp may be undesirable, because a user is required to retrieve shots that are not hit precisely along the center line, and using a retaining lip may not be desired because it can be noisy and can take energy from the ball, preventing it from returning to the intersection point.

FIG. 1(*a*) also shows support arms that provide stability for the gravity-powered golf putting ramp when receiving a ball. For example, it may be desirable to have a lightweight ramp. When a lightweight ramp without support arms receives a golf ball, the momentum of the ball may cause the leading edge of the ramp to lift. This ramp motion may cause the ramp to shift on the ground, and return a golf ball down a different return path. By including support arms that extend beyond the top-most edge (with respect to the leading edge), the ramp can be lightweight and stable.

FIG. 1(*c*) shows the radial version of the gravity-powered golf putting ramp with a return ramp. When a ball is struck down the center of the putting lane, it will be received in the body of the gravity-powered golf putting ramp. A set of balls may be stored inside the ramp (e.g., FIG. 1(*f*)), or a return ramp may be provided (e.g., FIG. 1(*c*)) that guides the ball around the back-side of the ramp and substantially back to the intersection point. This return ramp may be integrated with the gravity powered golf ramp, or it may be a separate piece.

FIG. 1(*e*) shows the bottom of the gravity powered golf ramp. In a preferred embodiment, the bottom of the gravity powered golf ramp is largely hollow to enable the ramp to be injection molded, and to allow the ramp to store golf balls. An attachment guide may be provided on the gravity-powered golf putting ramp to allow attachments to be removably fitted to the gravity-powered golf putting ramp, such as the return ramp (e.g., FIG. 1(*c*)), a golf-ball storage ramp (FIG. 1(*f*)), or other device.

The invention may include one or more sensors to detect the presence of a golf ball, attributes of the golf ball (e.g., speed, trajectory, etc.), and other characteristics of the golf ball at one or more points on the gravity-powered golf putting ramp. The sensor may be powered by its own battery, by a battery housed in the ramp, or by other means. The sensor and/or the ramp may have its own display (e.g., the number of observed putts for a given period, such as the number of putts in a day, the number of putts travelling down the putting arc and number of putts travelling down the gutter, changing display color based on the direction/velocity/apex point/return path, etc.), and the sensor may be configured with a communication interface (e.g., Bluetooth, Wi-Fi, etc.) to communicate information from the ramp to a service (e.g., a mobile phone, mobile device, laptop, desktop, or cloud service connected by cellular network, the internet, or other network). In one embodiment, the changing display color may include a green sensor that lights up when a golf ball travels over a first curve, but not over a second element (e.g., curve, lip, line, marker, etc., not shown), indicating that a ball was properly struck with respect to both direction and speed/weight/velocity.

Figure 5:
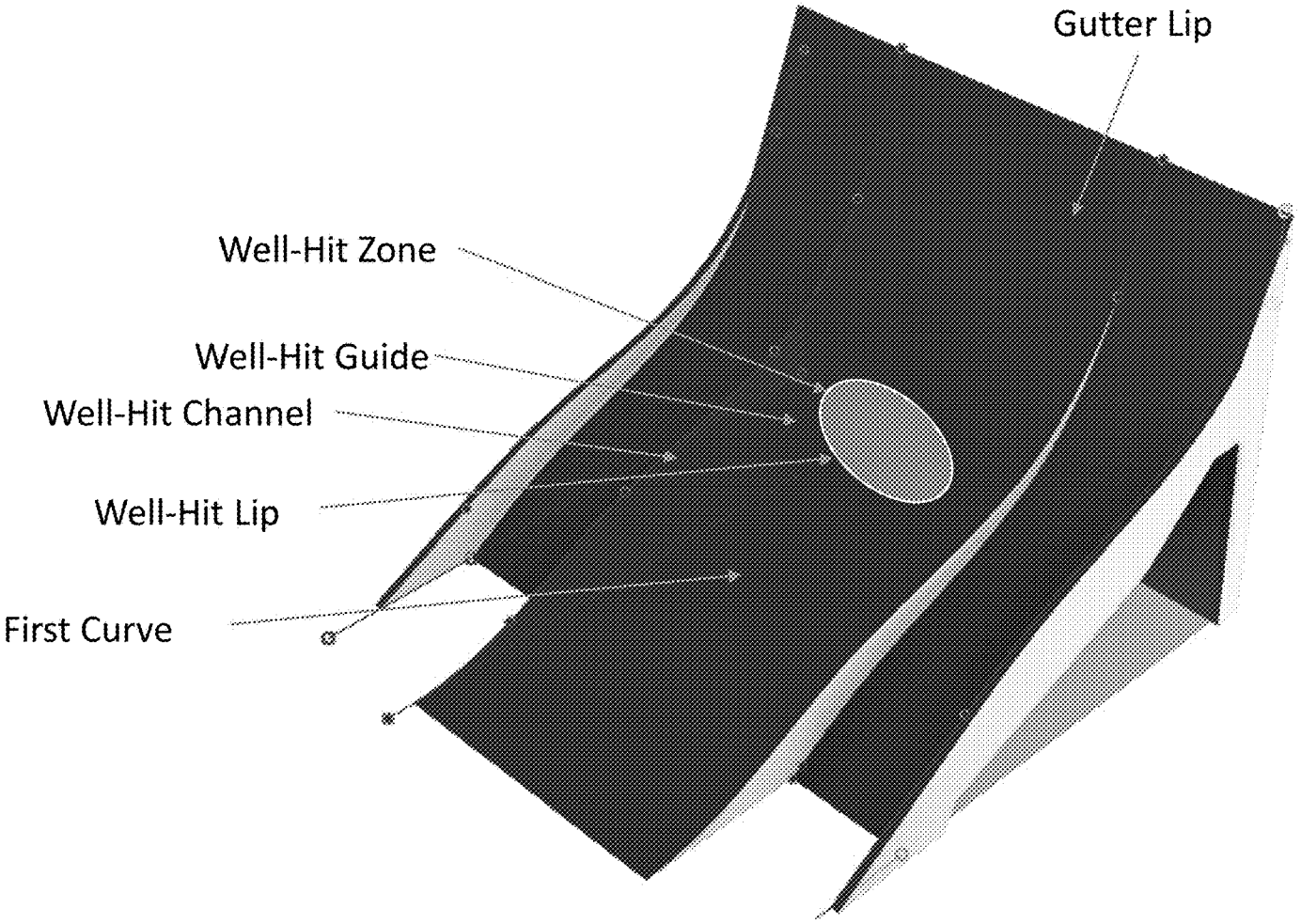
FIG. 5 is a plan view of a third embodiment of the gravity-powered golf putting ramp.

In one embodiment and as shown in FIG. 5, a gutter lip may be provided near the uppermost edge of the ramp to guide a ball struck too hard down a return path that is not the same as the putting arc, such as the gutter. Additionally, the ramp may include a well-hit guide that biases a golf ball down a well-hit channel that is different than the putting arc center line. For example, when a ball is hit so that it travels over a first curve of the ramp shown in FIG. 5, but not over a second element (e.g., a gutter lip), the ball will have an apex in a well-hit zone. By having a well-hit lip on the front edge of the well-hit zone that guides a golf ball to the left, to the right, or selectively to the left and right (e.g., slopes outwards from the putting arc center line), the golf ball may be diverted from the putting arc center line to return down a separate path, such as a return path defined by a well-hit guide. This well-hit guide may include a channel that guides a ball down a predetermined path that, for example, may travel along the putting arc edge. The well-hit guide may be slightly lower than the well-hit zone so that a ball hitting a well-hit lip will travel toward the well-hit guide. A display and/or sensor may be updated when a ball travels down the well-hit guide to indicate that a ball was well struck.

In one embodiment, the top-most edge of the gravity-powered golf putting ramp may be configured so that an apex of a travelling golf ball may be higher than top-most edge of the gravity-powered golf putting ramp. For example, the putting arc leading up to the top-most edge may have a face that is perpendicular to gravity (or negatively biased to gravity), such that a golf ball that is struck with a predetermined force travels above the top-most leading edge, reaches its apex, and then returns along the putting arc and in a direction at or near a user that initiated the golf ball motion.

We claim:

1. A gravity-powered golf putting ramp configured to receive a golf ball in motion in a first direction, guide the golf ball using an arced ramp in a second direction that increases gravitational potential energy, and guides the golf ball in a third direction that is the opposite of the first direction, the gravity-powered golf putting ramp comprising:

a planar base that supports the gravity-powered golf putting ramp when it is placed on a planar surface;

a leading edge connected to the planar base, the leading edge having a small height relative to a width of the leading edge;

a putting arc configured to receive a golf ball in motion, the putting arc connected to the leading edge and oriented in a direction similar to the planar base, the putting arc configured to:

guide the golf ball having a first amount of kinetic energy and having a first path that is at least partially in an upward direction from the planar base until the golf ball reaches an apex, at which point it has no kinetic energy and does have an amount of potential energy relative to the planar base; and guide the golf ball in a return path that is directionally different than the first path and that is downward from the apex;

the gravity-powered golf putting ramp further comprising: a center hole, configured to allow a golf ball to pass through a putting arc of the gravity-powered golf putting ramp, wherein the leading edge comprises a first arc defined by a first circle with a center point at the intersection point, a top-most edge has a second arc that is larger than the first arc and is defined by a second circle with the same center point, every point on the top-most edge is at the same height from the planar base, and the ratio of a first arc length to the diameter of the first circle is the same as the ratio of a second arc length to the diameter of the second circle.

2. The gravity-powered golf putting ramp of claim 1, wherein the length of the leading edge is approximately equal to the width of a golf hole, the center hole is slightly larger than the size of a golf ball and smaller than the length of the leading edge, and the length of the top-most edge is greater than the length of the leading edge.

3. The gravity-powered golf putting ramp of claim 2, further comprising a storage ramp configured to receive at least one golf ball that passes through the center hole.

4. The gravity-powered golf putting ramp of claim 2, further comprising a return ramp configured to return a golf ball that passes through the center hole to an intersection point that is in front of the leading edge.

5. The gravity-powered golf putting ramp of claim 1, further comprising a storage ramp configured to receive at least one golf ball that passes through the center hole.

6. The gravity-powered golf putting ramp of claim 1, further comprising a return ramp configured to return a golf ball that passes through the center hole to an intersection point that is in front of the leading edge.

* * * * *